US005611162A

United States Patent [19]

Idesawa

[11] Patent Number: 5,611,162

[45] Date of Patent: Mar. 18, 1997

[54] APPARATUS FOR FORMATION OF VISUAL SENSE EFFECT AND METHOD FOR FORMATION OF VISUAL SENSE EFFECT

[75] Inventor: Masanori Idesawa, Saitama-ken, Japan

[73] Assignee: Rikagaku Kenkyusho, Saitama-ken, Japan

[21] Appl. No.: 232,158

[22] PCT Filed: Sep. 14, 1993

[86] PCT No.: PCT/JP93/01307

§ 371 Date: Jul. 26, 1994

§ 102(e) Date: Jul. 26, 1994

[87] PCT Pub. No.: WO94/07232

PCT Pub. Date: Mar. 31, 1994

[30] Foreign Application Priority Data

Sep. 14, 1992 [JP] Japan ..... 4-245304
Jan. 28, 1993 [JP] Japan ..... 5-012212

[51] Int. Cl.[6] ..... G09F 19/00

[52] U.S. Cl. ..... 40/435; 40/430

[58] Field of Search ..... 40/430, 435, 436, 40/437, 445, 486; 116/284, 298, 302

[56] References Cited

U.S. PATENT DOCUMENTS 2,513,100 6/1950 Muri ..... 40/435
3,846,926 11/1974 Sullivan ..... 40/435 X
3,900,978 8/1975 Sloan ..... 40/435
5,269,086 12/1993 Tomes ..... 40/486

FOREIGN PATENT DOCUMENTS 36-28437 10/1961 Japan .
47-15940 6/1972 Japan .
55-28713 7/1980 Japan .
55-146480 11/1980 Japan .
59-229545 12/1984 Japan .
64-21484 1/1989 Japan .

*Primary Examiner*—Peter M. Cuomo
*Assistant Examiner*—James O. Hansen
*Attorney, Agent, or Firm*—Henderson & Sturm

[57] ABSTRACT

An apparatus for the formation of a visual sense effect comprises a first object A having a plurality of windows disposed around an axis of rotation C and a second object B so disposed as to show part thereof through the windows W of the first object A, with the first object A and the second object B adapted to be rotated relative to each other round the axis of rotation C. By virtue of the visual sense effect in vision, this apparatus allows an object of a polygonal shape to be perceived as though the object were repeating enlargement, contraction, deformation, and eccentric movement.

16 Claims, 14 Drawing Sheets

APPARATUS FOR FORMATION OF VISUAL SENSE EFFECT AND METHOD FOR FORMATION OF VISUAL SENSE EFFECT

BACKGROUND OF THE INVENTION

1. Technical Field

This invention relates to an apparatus for the formation of a visual sense effect and a method for the formation of a visual sense effect which form a visual sense effect of enabling an object of a polygonal shape to be perceived as though it were repeating enlargement, contraction, deformation, and an eccentric motion by virtue of the illusionary effect in the visual sense.

2. Background Art

Heretofore, as means to produce a visual sense effect of enabling an object of a polygonal shape to be perceived as though it were repeating enlargement, contraction, deformation, and an eccentric motion, the method which actually causes an image of the object of a polygonal shape to be enlarged, contracted, deformed, and eccentrically moved has been known in the art.

The visual sense effect which is obtained at all by the conventional method described above, however, is confined within the realm of prediction. Thus, this method has not been fully capable of permitting perception of unexpectedness.

This invention, produced in view of the true state described above, has for an object thereof the provision of an apparatus for the formation of a visual sense effect and a method for the formation of a visual sense effect which enable an object of a polygonal shape to be perceived as though it were being enlarged, contracted, deformed, and eccentrically moved and giving rise to strange unexpected, notwithstanding the object is not physically being enlarged, contracted, deformed, and eccentrically moved.

Disclosure of the Invention

The apparatus for the formation of a visual sense effect according to this invention comprises a first object having windows arranged around an axis of rotation and a second object of a polygonal shape so disposed that part thereof may be seen through the windows of the first object and is characterized by enabling the first object and the second object to be rotated relative to each other round the axis of rotation.

The apparatus for the formation of a visual sense effect according to this invention comprises a first object having concealing parts arranged around an axis of rotation and a second object of a polygonal shape so disposed that part thereof may be rendered invisible by being concealed with the concealing parts of the first object and is characterized by enabling the first object and the second object to be rotated relative to each other round the axis of rotation.

The apparatus for the formation of a visual sense effect according to this invention comprises a first object having mirror surfaces arranged around an axis of rotation and a second object of a polygonal shape so disposed that part thereof may be reflected by the mirror surfaces of the first object and is characterized by enabling the first object and the second object to be rotated relative to each other round the axis of rotation.

The method for the formation of a visual sense effect according to this invention is characterized in that a first figure corresponding to a first object having windows arranged around an axis of rotation and a second figure corresponding to a second object of a polygonal shape so disposed that part thereof may be seen through the windows of the first object are so displayed on an image plane as to be rotated relative to each other round the axis of rotation.

The method for the formation of a visual sense effect according to this invention is characterized in that a first figure corresponding to a first object having concealing parts arranged around an axis of rotation and a second figure corresponding to a second object of a polygonal shape so disposed that part thereof may be rendered invisible by being concealed with the concealing parts of the first object are so displayed on an image plane as to be rotated relative to each other round the axis of rotation.

In the present invention, an object of a polygonal shape which actually is not being enlarged, contracted, deformed, or eccentrically moved at all is enabled by virtue of the newly found illusionary phenomenon in the visual sense to be perceived as though it were being enlarged, contracted, deformed, and eccentrically moved.

The illusionary phenomenon mentioned above purports to portray the fact that even when an object of a polygonal shape is partially concealed and is not wholly revealed, the entire shape of the object is eventually conceived as the concealed part is sequentially changed and this entire shape is conceived as though it were wholly contracted particularly when the top part of the object and its vicinity is concealed.

The first object which has a plurality of windows, concealing parts, or mirror surfaces arranged around an axis of rotation plays the role of partially concealing the second object of a polygonal shape. When the first object and the second object are rotated relative to each other and, as a result, the concealed part (and consequently the revealed part) of the second object of a polygonal shape is sequentially moved, the top part of the object is conceived as though it were contracted in a concealed state or it were enlarged in a revealed state.

By varying the size of windows, for example, the proportion of the concealed part of the object is varied and the effect of enlargement, contraction, deformation, and eccentric movement is proportionately varied. By causing the first object and the second object to be displayed as a figure with the aid of a computer and consequently enabling the position, size, etc. of the windows to be freely varied, the formation of the visual sense effect is attained with exalted flexibility.

Optionally, the position, size, etc. of the windows may be altered by either altering the first object or manufacturing the first object with a plate such as, for example, a liquid crystal image display panel which is endowed with a light modulating function and, therefore, enabled to control penetration of light therethrough.

Further, the formation of the visual sense effect can be optically attained by causing the figure produced as described above to be optically projected as magnified.

When the first object makes use of mirror surfaces, the visual sense effect can be formed by having holograms recorded in advance on mirror surfaces.

BEST MODE OF EMBODIMENT OF THE INVENTION

Now, the present invention will be described in detail below with reference to the accompanying drawings.

FIGS. 1 to 6 illustrate the constructions of apparatuses respectively of the first through sixth embodiments of the present invention. In these diagrams, A stands for a first object provided with windows W and B for a second object of a polygonal shape so disposed as to be concealed by the first object A.

The first object A and the second object B are constructed so as to be rotated relative to each other round an axis of rotation C as the center. When they are rotated relative to each other, parts of the second object B (indicated by slanted lines in the diagram) appear and disappear from the windows W of the first object A.

In the first embodiment illustrated in FIG. 1, the first object A is constructed in a square shape (which remark holds good for the second through fourth embodiments to be described hereinafter) and has four circular windows W arranged therein. The second object B is constructed in a square shape of a size such that the four corners thereof appear from these windows W. In the second embodiment illustrated in FIG. 2, the first object A has four square windows W arranged therein and the second object is constructed in a square shape of a size such that the four corners thereof appear from the windows W.

Figure 3:
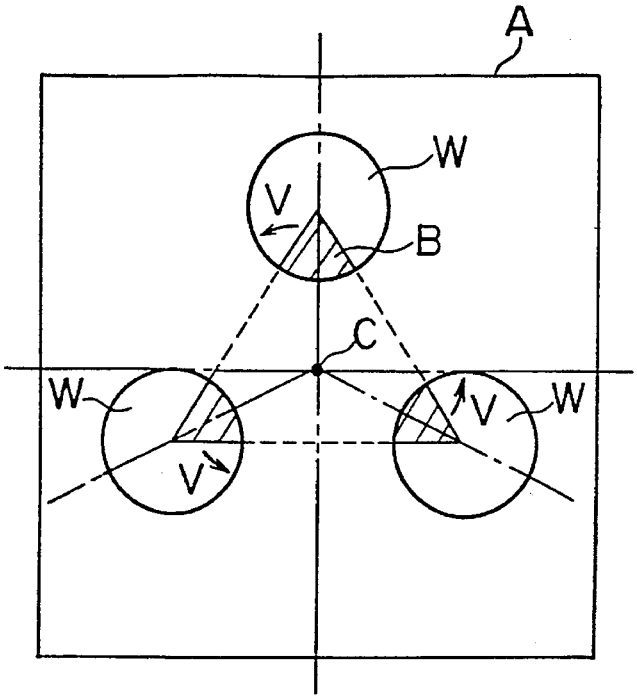
FIG. 3 is a diagram illustrating the construction of a third embodiment of the present invention.

In the third embodiment illustrated in FIG. 3, the first object A has three circular windows W arranged therein and the second object B is constructed in a triangular shape of a size such that the apexes thereof appear from the windows W.

Figure 4:
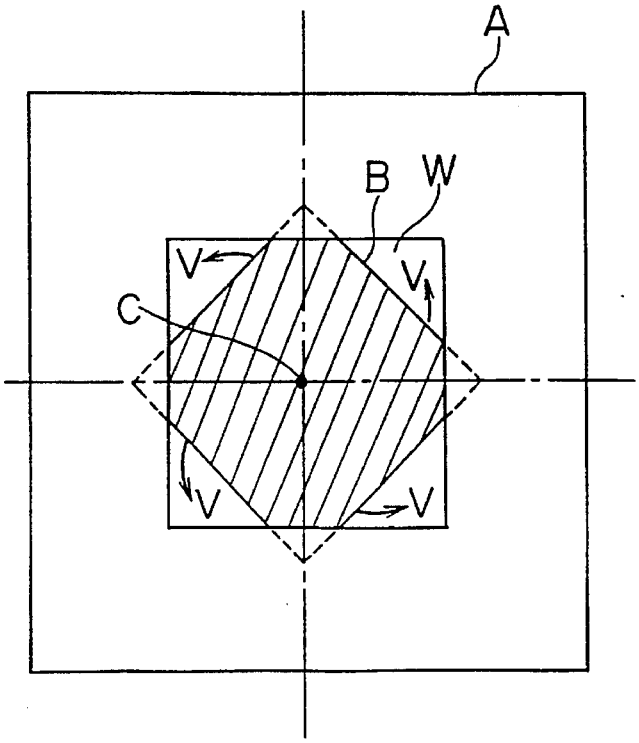
FIG. 4 is a diagram illustrating the construction of a fourth embodiment of the present invention.

In the fourth embodiment illustrated in FIG. 4, the first object A has a square window W which, though singular physically, is so constructed as to reveal therethrough at a certain rotary position a plurality of parts of the contour of the second object B which is constructed in a square shape.

Figure 5:
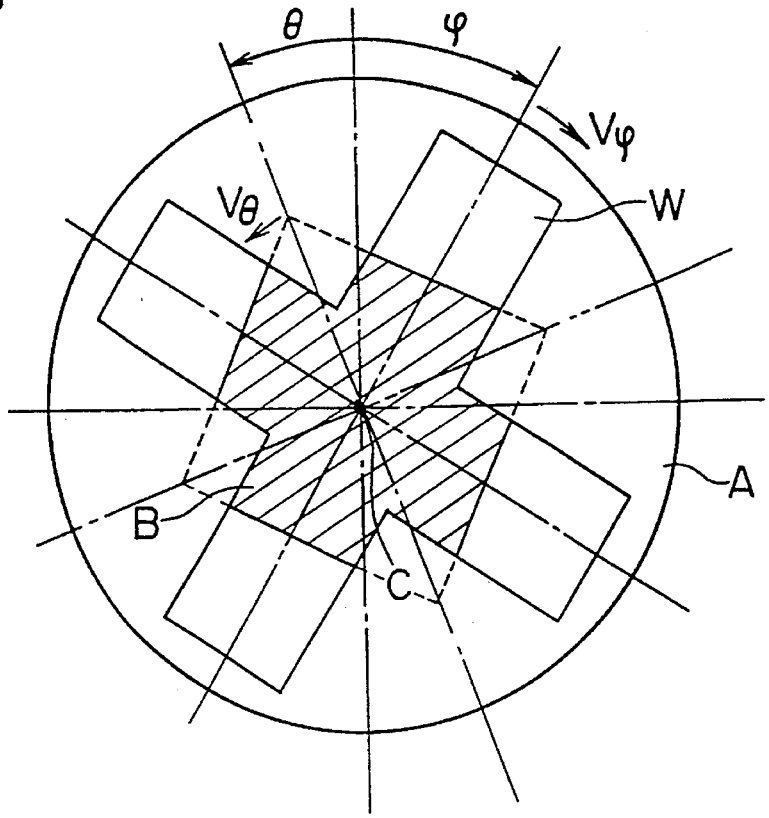
FIG. 5 is a diagram illustrating the construction of a fifth embodiment of the present invention.

In the fifth embodiment illustrated in FIG. 5, the first object A is constructed in a circular shape and the window W which is provided in the first object A is formed of a cruciform perforation. The second object B is constructed in a square shape.

Figure 6:
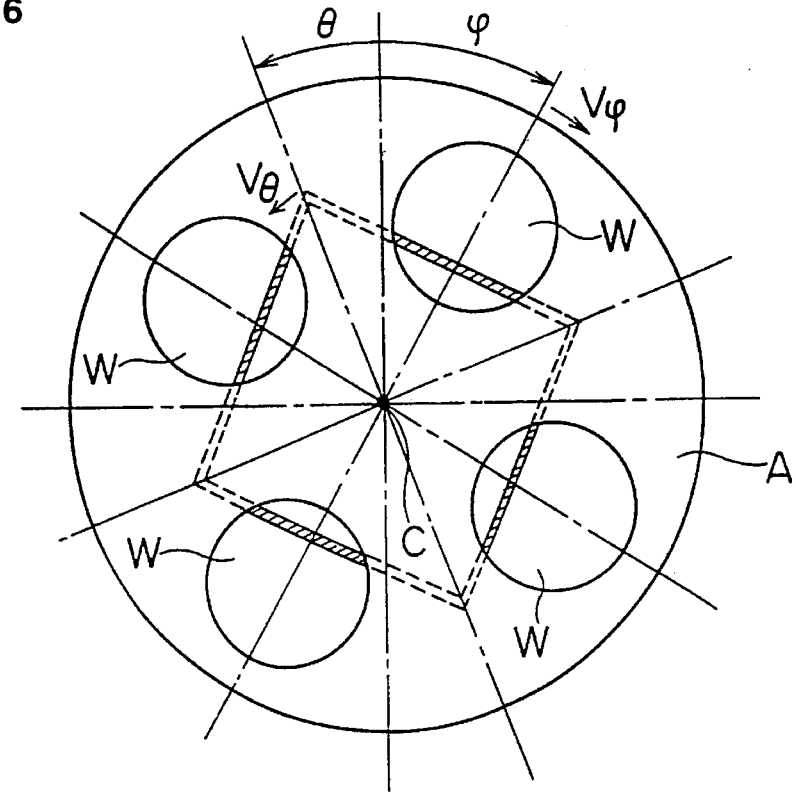
FIG. 6 is a diagram illustrating the construction of a sixth embodiment of the present invention.

In the sixth embodiment illustrated in FIG. 6, the first object A is constructed in a circular shape and has four circular windows W arranged therein. The second object B is constructed in the shape of a frame.

FIGS. 7 to 10 illustrate the constructions respectively of seventh to tenth embodiments each using a first object D provided with concealing parts adapted to conceal parts of a second object B in the place of the first object A provided with windows W. In these embodiments, the first object D and the second object B are so constructed as to be rotated relative to each other round the axis of rotation C as a center. When these objects are set rotating, parts (indicated by slanted lines in the diagram) of the second object B are allowed to appear and disappear from the outlines of the first object D.

Figure 7:
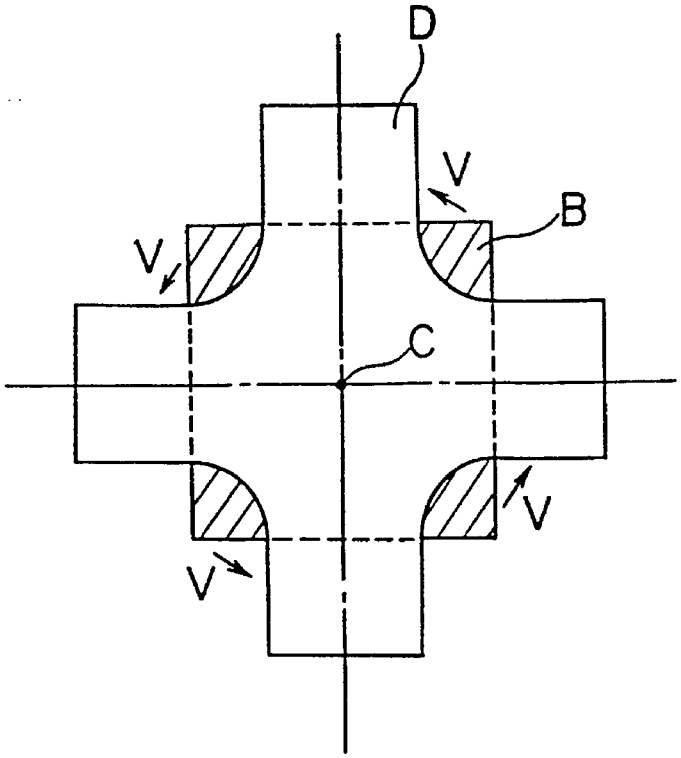
FIG. 7 is a diagram illustrating the construction of a seventh embodiment of the present invention.
Figure 8:
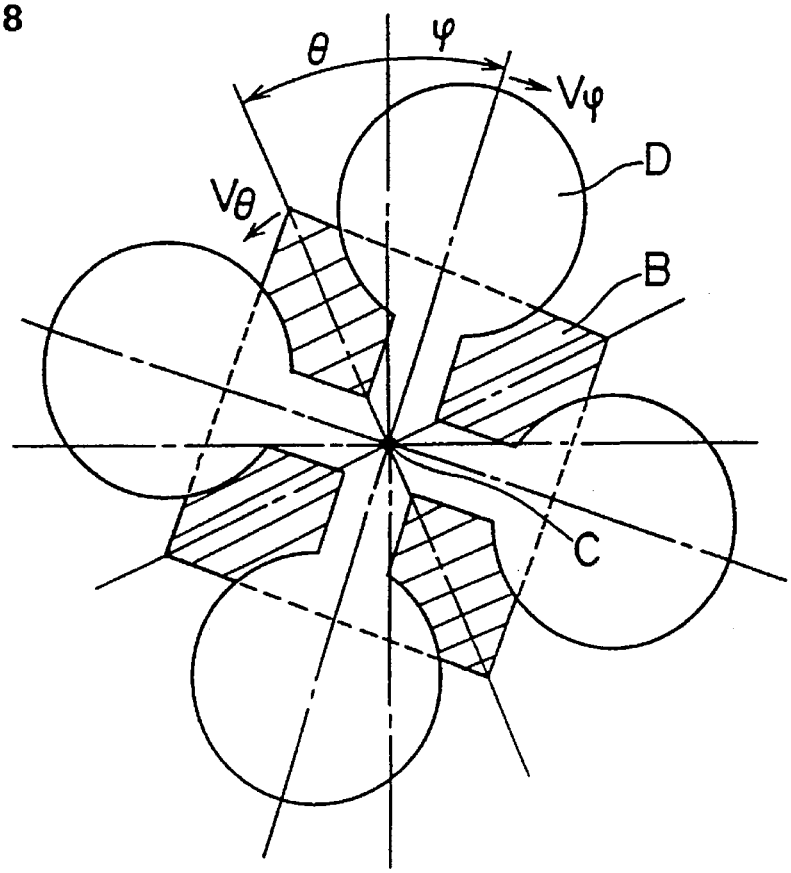
FIG. 8 is a diagram illustrating the construction of a eighth embodiment of the present invention.
Figure 9:
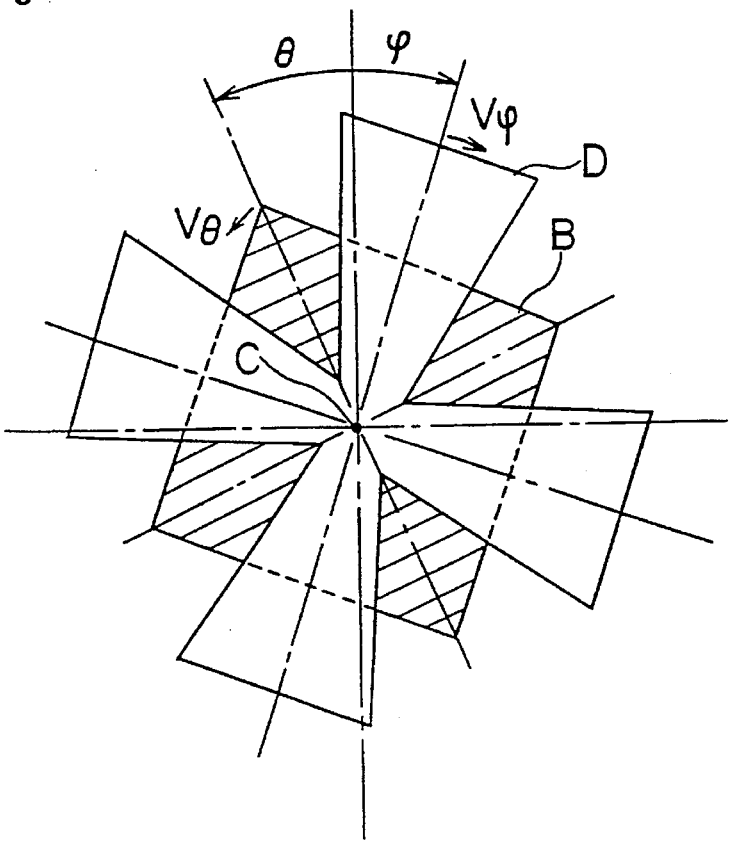
FIG. 9 is a diagram illustrating the construction of a ninth embodiment of the present invention.

In the seventh to ninth embodiments shown respectively in FIGS. 7 to 9, the first object D is constructed by having a plurality of concealing parts disposed radially around the axis of rotation C as a center and the second object B is constructed in a square shape.

Figure 10:
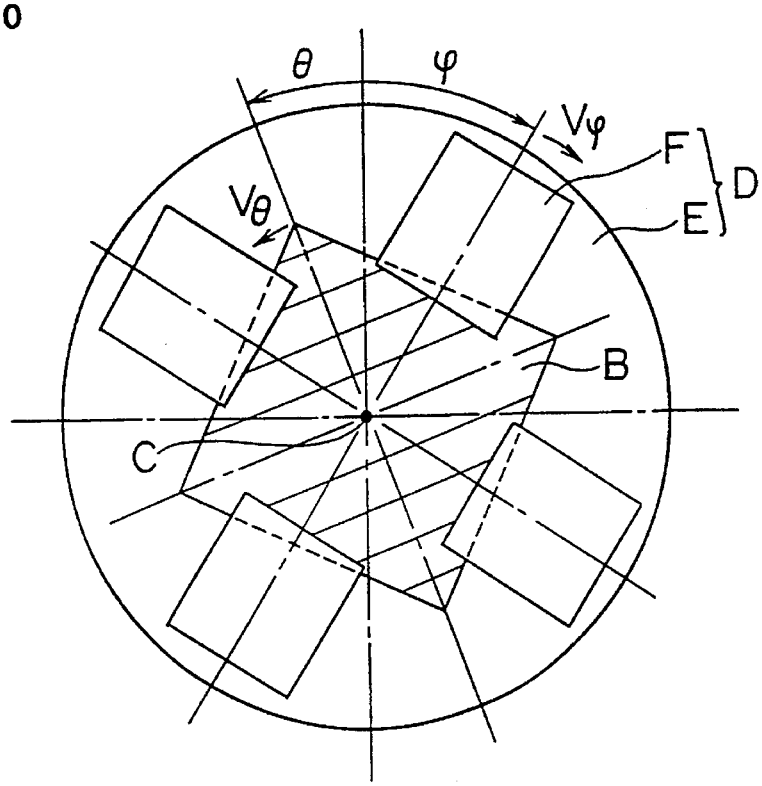
FIG. 10 is a diagram illustrating the construction of a tenth embodiment of the present invention.

In the tenth embodiment shown in FIG. 10, the first object D is constructed by having a plurality (four specifically in the present embodiment) of concealing parts F disposed radially on a transparent disc E around the axis of rotation C as a center.

In each of the embodiments described above, not only the effect of enlargement and contraction but also the effect of deformation and eccentric movement can be obtained by differentiating the number of windows in the first object A or the number of concealing parts in the first object D from the number of angles of the second object B of a polygonal shape. By causing the number of windows or that of concealing parts to be smaller than the number of angles of the second object B of a polygonal shape and disposing the windows or concealing parts so that part of the angles of the second object B of a polygonal shape appear and other part thereof disappear from the windows or concealing parts, the visual sense effect of enabling the second object B of a polygonal shape to be perceived as though it were deforming.

The effect of eccentric movement can be obtained by setting the number of angles of the second object B of a polygonal shape and setting the number of windows or that of concealing parts at (n−1) or (n+1).

Figure 11:
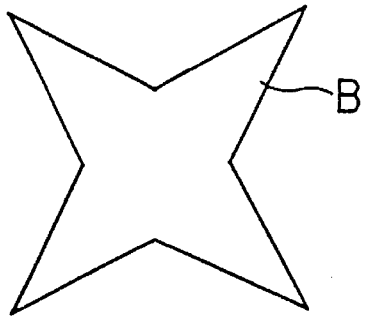
FIG. 11 is a diagram illustrating another example of the construction of a second object.

The second object B of a polygonal shape is not always required to possess only projecting parts as in the case of a regular polygon. Even when the second object B comprises both projecting parts and receding parts as shown in FIG. 11, the same effect as described above is obtained. The angles of the receding parts, contrary to the angles of the projecting parts, are perceived as though they were contracting when they appear and as though they were enlarging when they do not appear.

In the embodiments cited thus far, the windows or the concealing parts of the first object A or D are uniformly spaced on a circle having the axis of rotation as the center thereof. This arrangement of the windows or concealing parts does not always constitute an essential requirement. A still different visual sense effect can be realized when the windows or concealing parts are so disposed that they fail to fall on a circle of a fixed radius or they are not uniformly spaced. The situation described above holds good for the second object. To be specific, the embodiments cited thus far represent cases of causing positions corresponding to the apexes of a polygonal object to be uniformly spaced on a circle having the axis of rotation as the center thereof or causing the angles of a polygonal object to veer and overlap. The parts which correspond to the angles of a polygonal object are not always required to be disposed on a circle having the axis of rotation as the center thereof or to be uniformly spaced on the circle. By forming the polygonal object in a shape such that the parts mentioned above may be neither disposed on the circle nor spaced uniformly, a further different visual sense effect can be realized.

Figure 12:
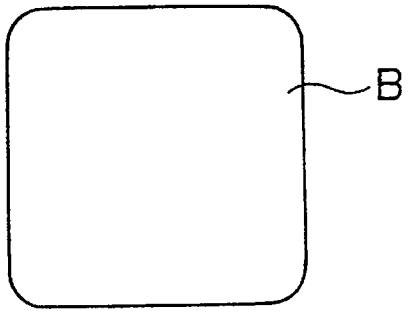
FIG. 12 is a diagram illustrating yet another example of the construction of the second object.
Figure 13:
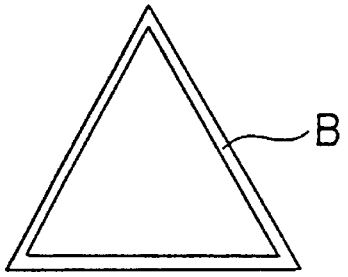
FIG. 13 is a diagram illustrating still another example of the construction of the second object.
Figure 14:
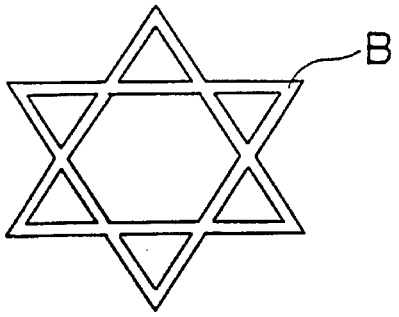
FIG. 14 is a diagram illustrating a further example of the construction of the second object.

The second object B of a polygonal shape is not always required to possess definite angles. Even when the angular parts of the second object B are rounded as shown in FIG. 12, this second object B produces the same effect as described above.

The polygonal object does not need to be limited to the shape of a plate or the plane shape of a window. It may be in the shape of lines such as those of a frame or in the shape of what is obtained by superposing such lines.

These embodiments invariably represent cases of using the second object B exclusively as a rotary member. They will bring about entirely the same effect if the first object A or D is used as a rotary member instead or if the two objects are rotated in opposite directions or if they are rotated in one same direction at different speeds.

The effect of the rotation is prominent when the speed of this rotation is in the approximate range of from one revolution per some tens of seconds to one or two revolutions per second. The number of angles of the polygon is desired to be in the approximate range of 3 to 9. The perception of enlargement and contraction will dwindle if the number of angles exceeds the upper limit of this range.

Figure 15:
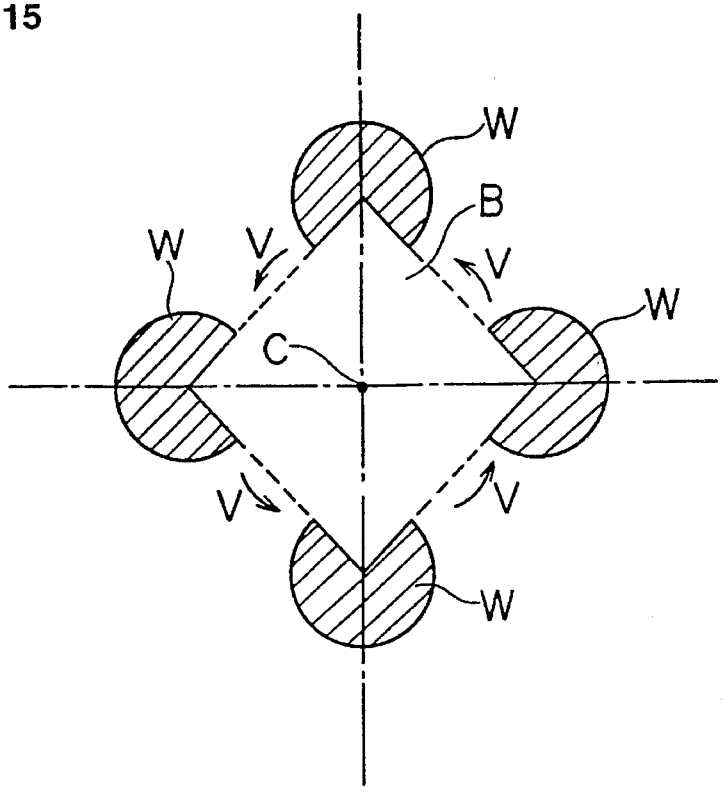
FIG. 15 is a diagram illustrating the construction of an 11th embodiment of the present invention.

FIG. 15 represents an 11th embodiment which effects display by the use of the technique of computer graphics. In this case, the display is attained as an equivalent to the fact that part of the light leaking through the windows W is intercepted by the second object B and rendered no longer visible.

Figure 16:
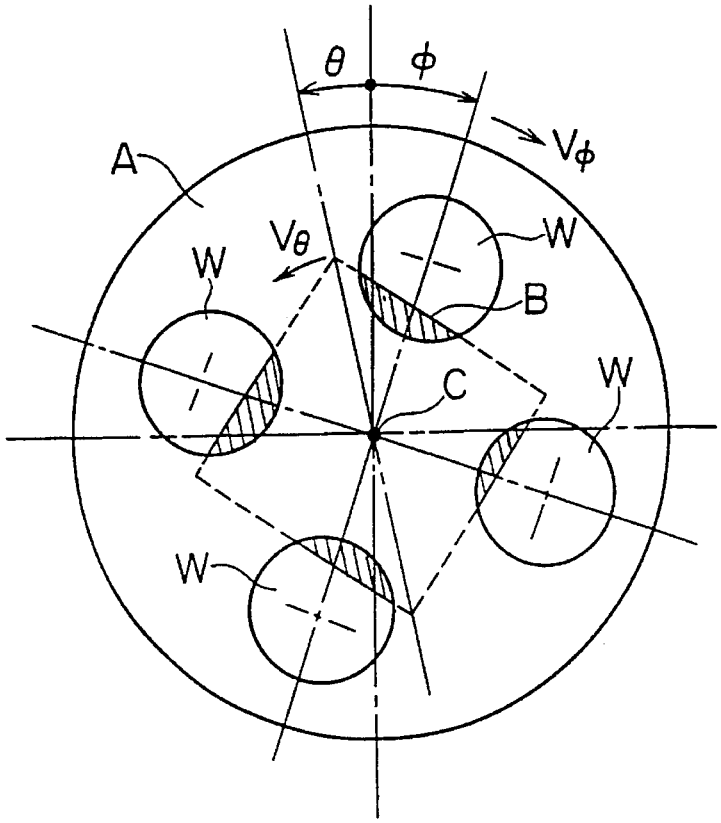
FIG. 16 is a diagram to aid in the explanation of relative rotation of a first object.

The display by the use of a computer is realized by varying the angles of rotation, $\phi$ and $\theta$, of the first object A and the second object B shown in FIG. 16 with the elapse of time as indicated by the following formulas and displaying the results of the variation:

$$\phi=\phi_0+v_\phi.t$$

$$\theta=\theta_0+v_\theta.t$$

This operation is easily carried out by adopting the technique of computer graphics currently in popular use. Specifically, it can be realized by forming computer models of the first object A and the second object B, rotating these computer models with the aforementioned angles $\phi$ and $\theta$, subjecting the computer models in process of rotation to a concealing treatment, and displaying the results of the treatment. This operation constitutes a very common technique today.

In the embodiments described above, when the first object A or D and the second object B are equally contrasted in color and brightness to a hardly discriminable extent in the part excluding the windows W or the region excluding the concealing parts, these embodiments bring about the same effect even if the positional relation between the first object A or D and the second object B is reversed from the viewpoint of an observer's eye.

Now, the embodiments using mirror surfaces will be described more specifically below.

Figure 1:
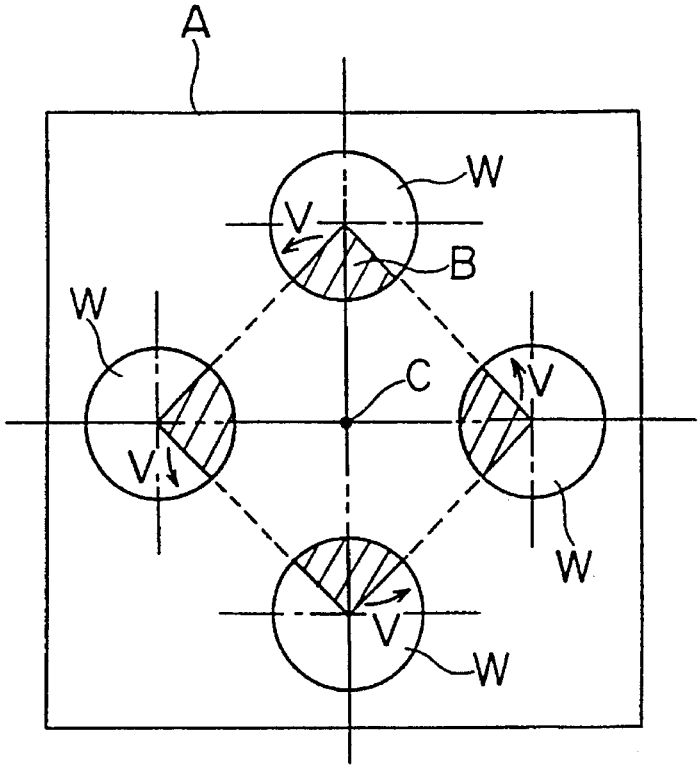
FIG. 1 is a diagram illustrating the construction of a first embodiment of the present invention.
Figure 2:
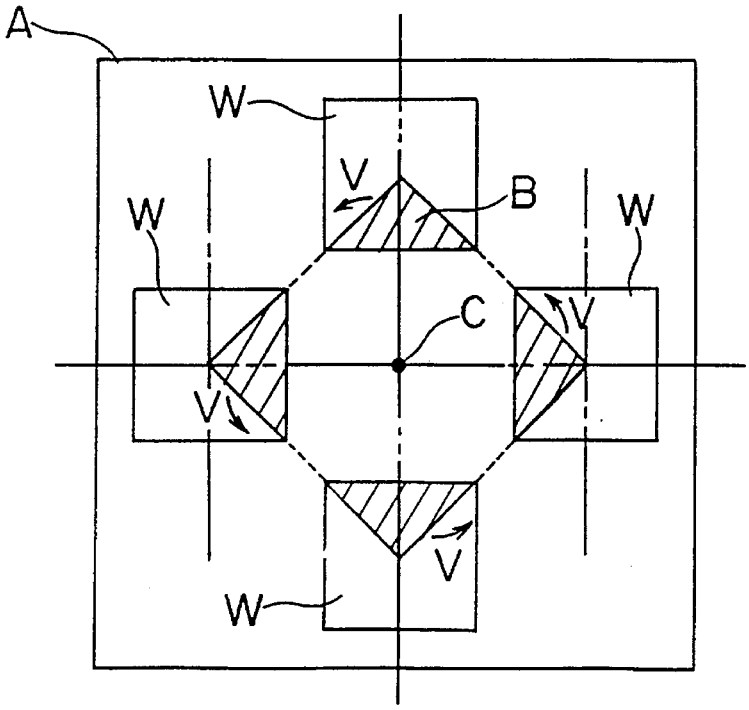
FIG. 2 is a diagram illustrating the construction of a second embodiment of the present invention.
Figure 17:
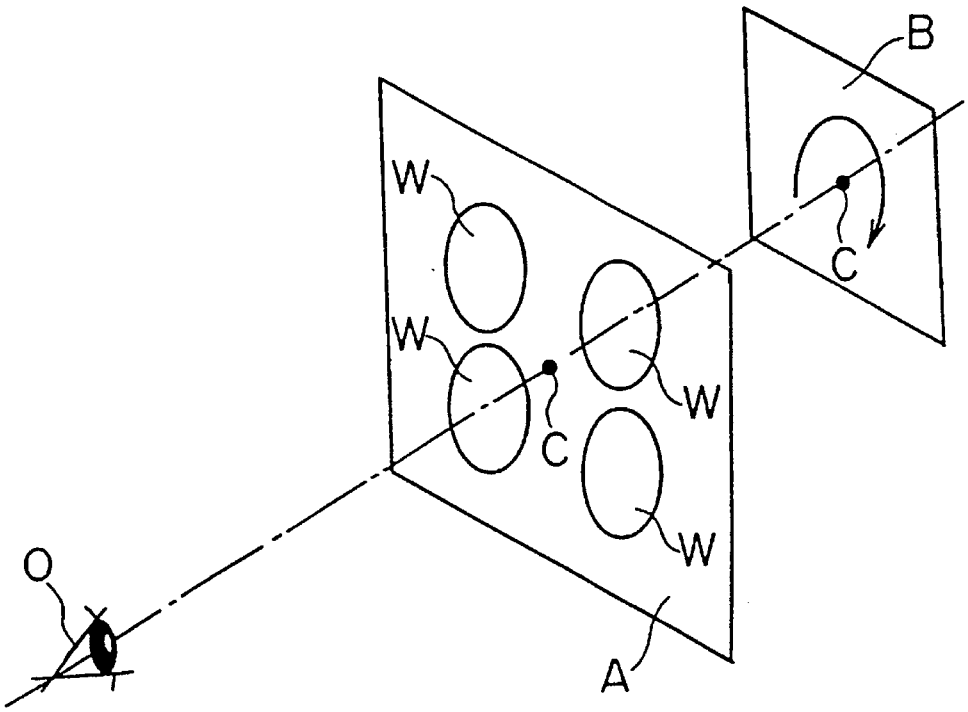
FIG. 17 is a diagram three-dimensionally illustrating the construction of the first embodiment.
Figure 18:
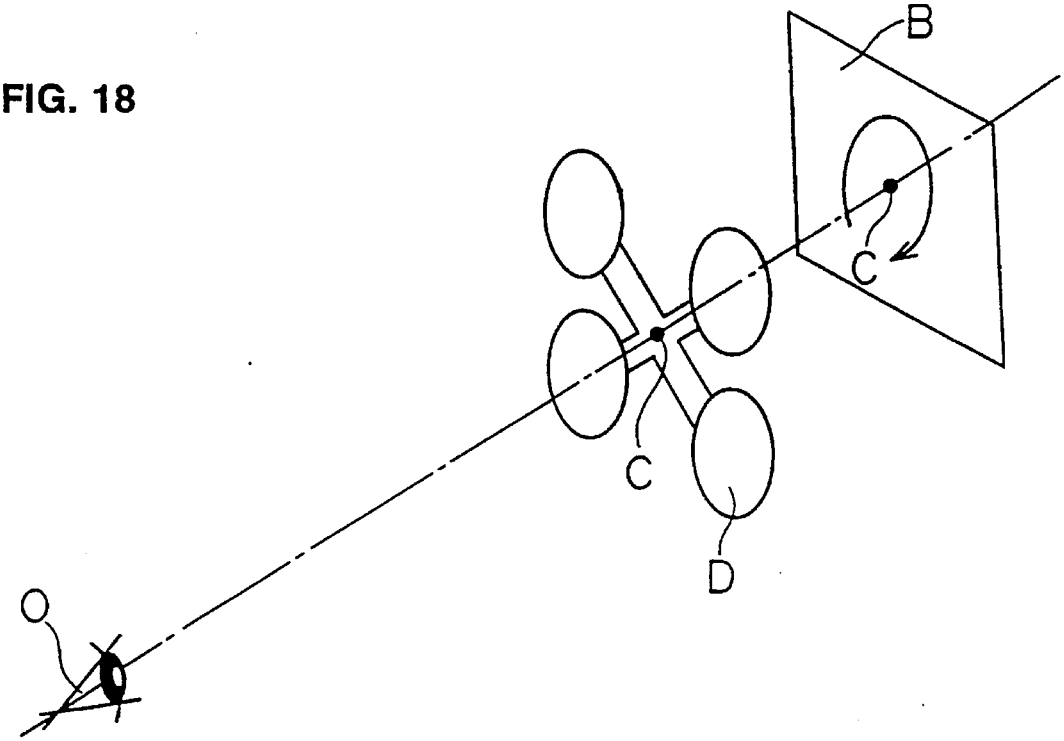
FIG. 18 is a diagram three-dimensionally illustrating the construction of the eighth embodiment.
Figure 19:
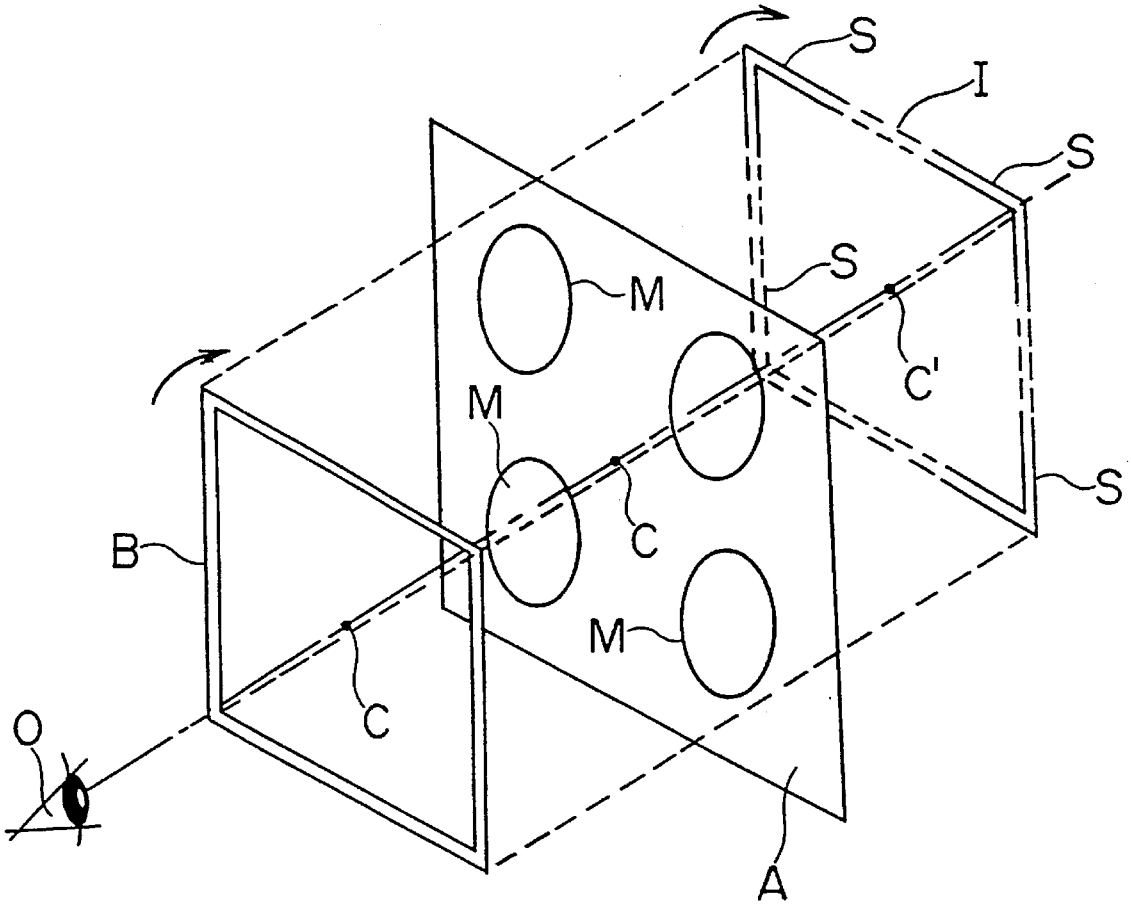
FIG. 19 is a diagram illustrating the construction of a 12th embodiments of the present invention.

FIG. 17 and FIG. 18 are perspective views illustrating three-dimensionally the constructions respectively of the first embodiment shown in FIG. 1 and the eighth embodiment shown in FIG. 8. In these diagrams, O stands for an observer. FIG. 19 represents the construction of a 12th embodiment of the present invention using mirror surfaces M. To be specific, in this embodiment, the first object A provided with partial mirror surfaces M is disposed opposite the observer O and the second object B adapted to be rotated relative to the first object A is interposed between the first object A and the observer O.

Figure 20:
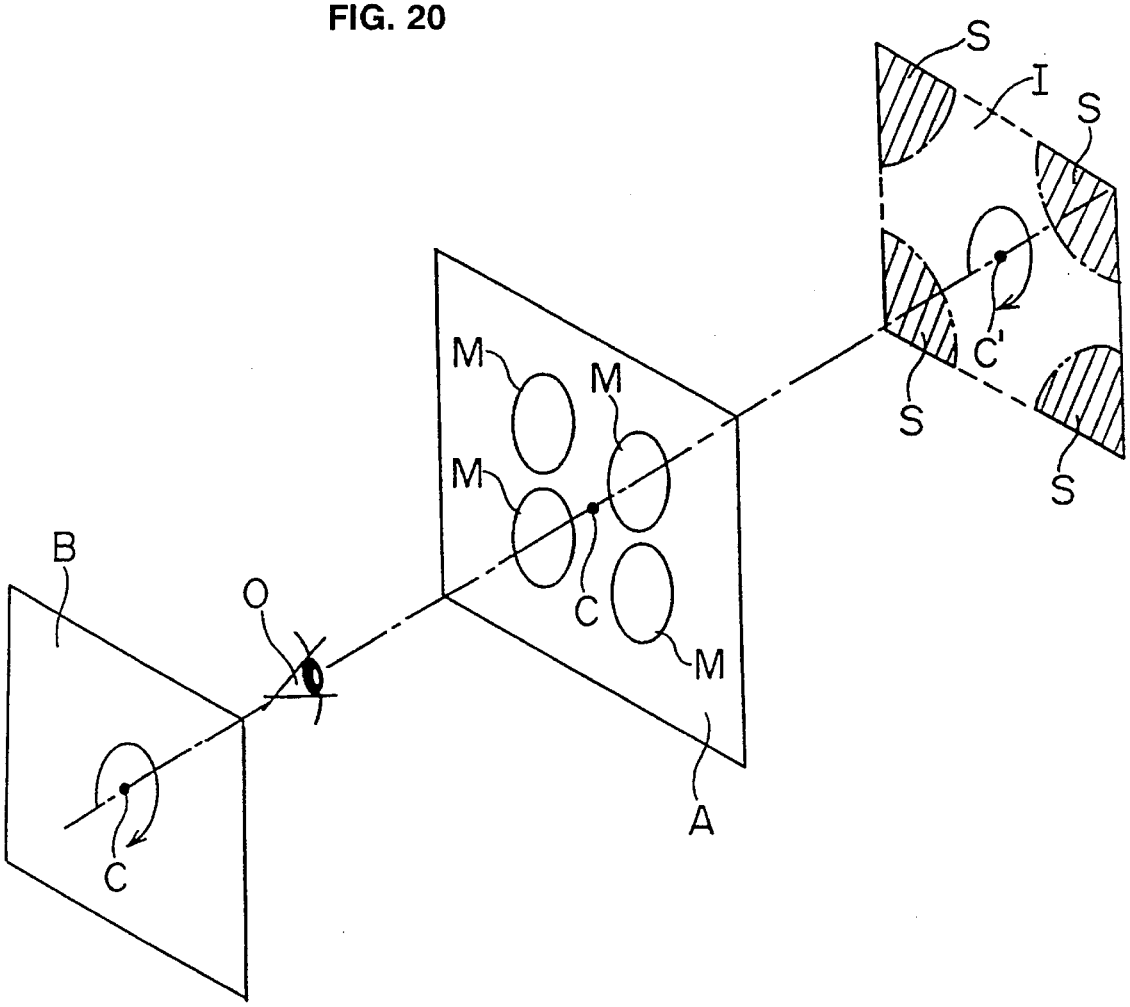
FIG. 20 is a diagram illustrating the construction of a 13th embodiment of the present invention.

In a 13th embodiment of this invention illustrated in FIG. 20, the second object B is disposed behind the observer O and the first object A provided with mirror surfaces M and the second object B are opposed to each other across the observer O.

In the 12th and 13th embodiments which are constructed as described above, if the entire surface of the first object A consists of a mirror surface, an image I on the second object B will correspond to the second object B of FIG. 17. If partial specular images M are formed on the first object A, then they will correspond to windows W. Thus, these embodiments bring about an effect equivalent to what is produced by the first embodiment illustrated in FIG. 17.

The embodiments of FIG. 19 and FIG. 20 bring about the same effect even when they are so constructed that the mirror surfaces M and the remaining part of the first object A are interchanged, namely when they are so constructed that the first object A is wholly formed of a mirror surface and concealing parts are disposed in the portions which would be otherwise occupied by mirror surfaces M. The effect which is attained in this case is equivalent to the effect produced by the eighth embodiment in which the first object D incorporating concealing parts therein is disposed as illustrated in FIG. 18.

In the 12th embodiment illustrated in FIG. 19, since the second object B is interposed between the observer O and the first object A, the second object B would normally obstruct the observer's field of view. This problem cannot arise when the second object B of the shape of a frame as illustrated in FIG. 19 is used.

Then, in the 13th embodiment illustrated in FIG. 20, since the observer O has his position between the first object A and the second object B, this embodiment has the possibility that the observer O will obstruct the formation of an image of the second object B. This possibility can be precluded by constructing the apparatus in amply large dimensions relative to the volume of the observer O or by properly devising a method of observation.

Further in the 12th and 13th embodiments illustrated in FIGS. 19 and 20, the apparatus is so constructed that the first object A, the second object B, and the observer O may be set at positions which fall on one same axis (axis of rotation). It is permissible to construct the apparatus so that the observer O will make required observation at a position deviating from the axis, namely in a diagonal direction. The apparatus which is thus constructed possibly brings about a visual sense effect different from what is obtained when the observation is made from a position on the axis and also solves the problem that the second object B obstructs the field of view or the problem that the observer O obstructs the formation of image.

Figure 21:
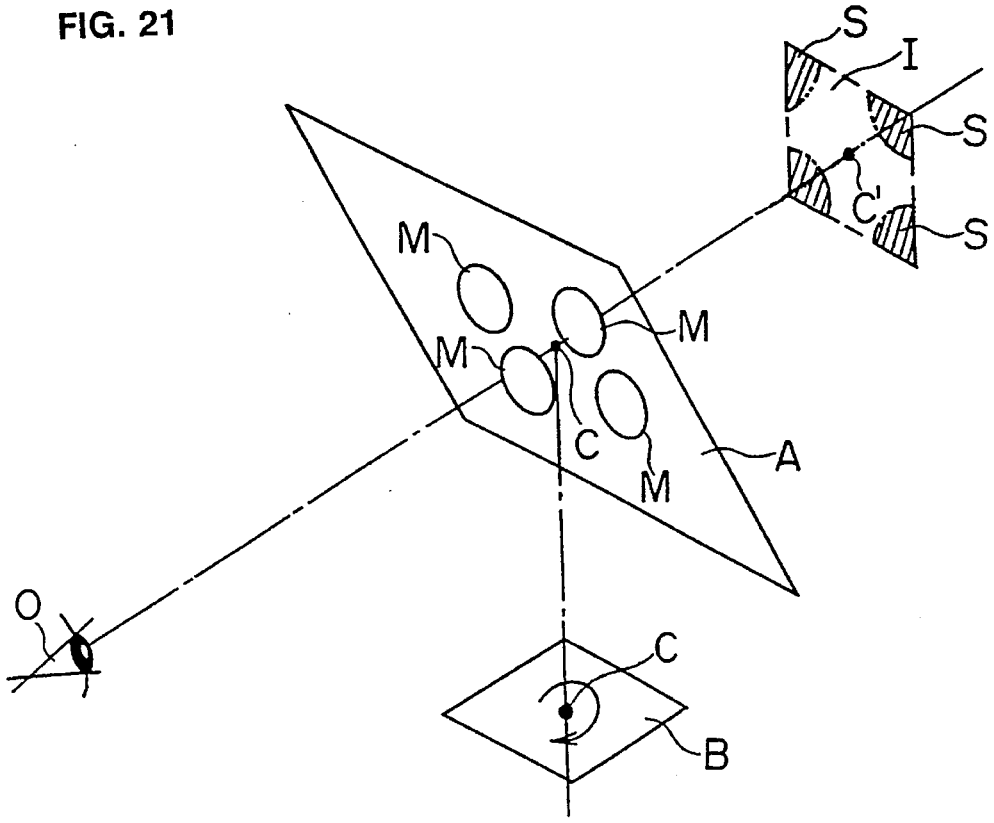
FIG. 21 is a diagram illustrating the construction of a 14th embodiments of the present invention.

FIG. 21 illustrates a 14th embodiment which is constructed so that the first object A, the second object B, and the observer O may not be set at positions which fall on one and the same axis (axis of rotation). This embodiment is constructed lest the plane of the first object A and that of the second object B should run parallelly with each other.

In the present embodiment which is thus constructed, the image on the second object B which is partially observable and the main body of the second object B can be simultaneously observed, with the result that the comparison of the two views exalts the marvel of visual sense effect prominently.

Figure 22:
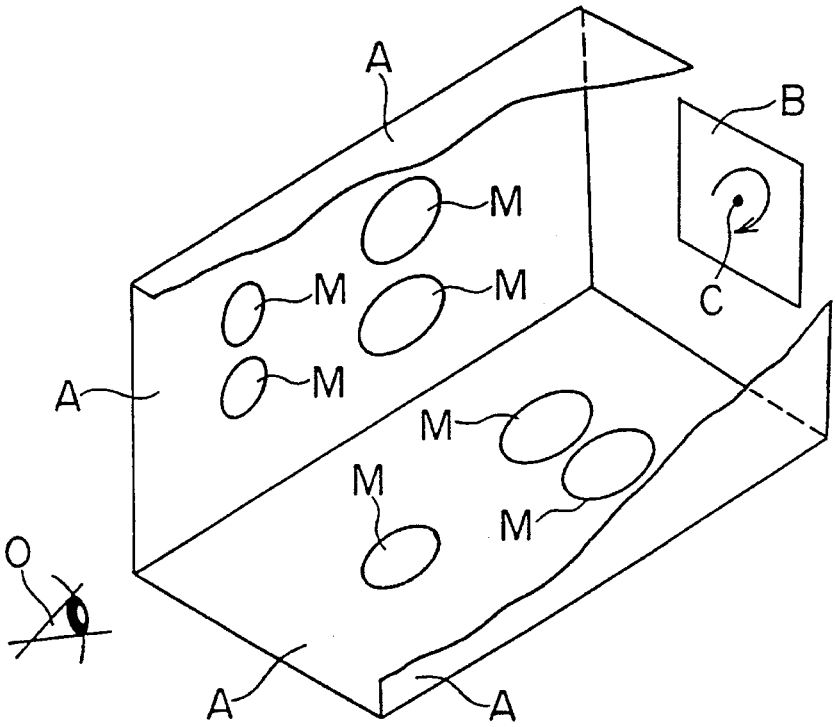
FIG. 22 is a diagram illustrating the construction of a 15th embodiment of the present invention.

FIG. 22 illustrates the construction a 15th embodiment having a plurality of first objects A arranged after the fashion of a kaleidoscope. In this embodiment, different visual sense effects can be simultaneously observed by varying the disposition of partial mirror surfaces M in each of the first objects A.

The 12th to 15th embodiments which have partial mirror surfaces M disposed in the first object A as described above can be constructed to attain formation of a holographic image on the front or the rear surface of the first object A by having a hologram recorded in advance on the mirror surfaces M. In this case, the mirror surfaces having a hologram recorded in advance thereon can be formed with virtually no sacrifice of the quality of the second object B as the mirror surface for the formation of an image. This construction can add a new visual sense effect due to the relationship of interference between the formed holographic image and the second object B itself or the image thereon.

The first to 15th embodiments described above are enabled to produce different visual sense effects by varying the windows W, concealing parts, and mirror surfaces M on the first object A in quantity and layout. These embodiments are enabled to impart greater prominence to their visual sense effects by using one fixed second object B and preparing a plurality of first objects A and sequentially putting them to use. In this case, the impartation of prominence can be attained more effectively by automating the sequential use of the plurality of first objects A.

Figure 23:
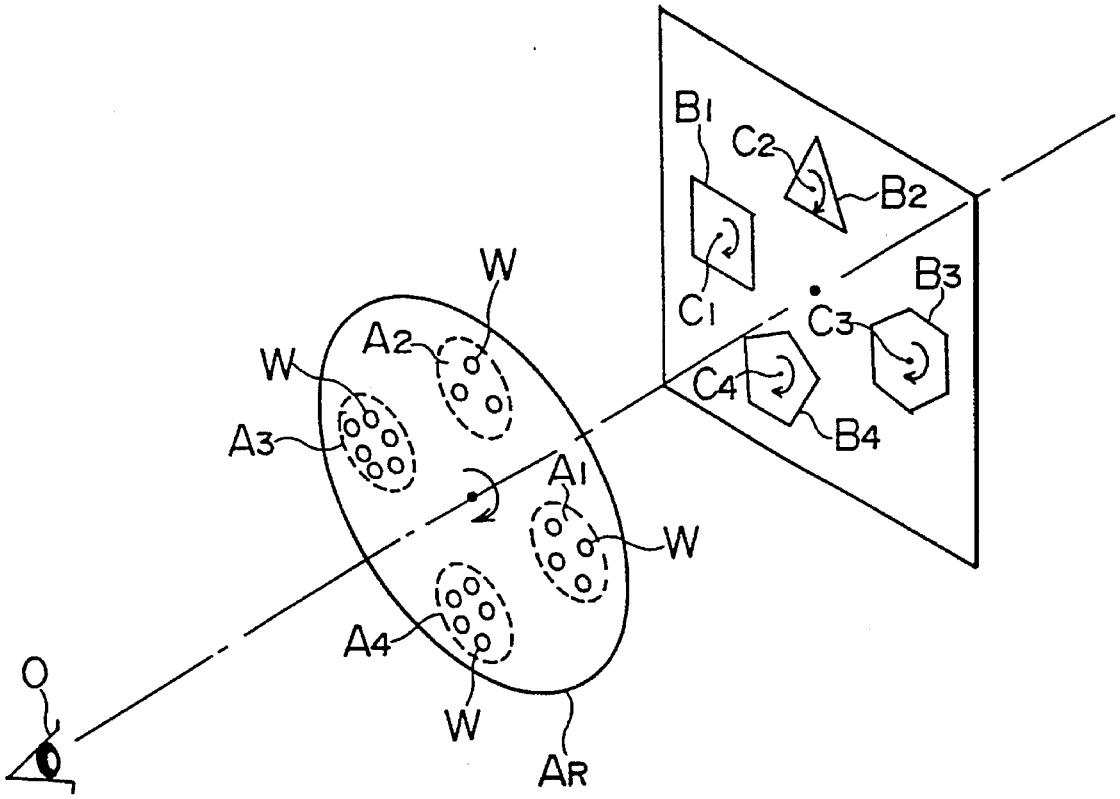
FIG. 23 is a diagram illustrating the construction of a 16th embodiment of the present invention.
Figure 24:
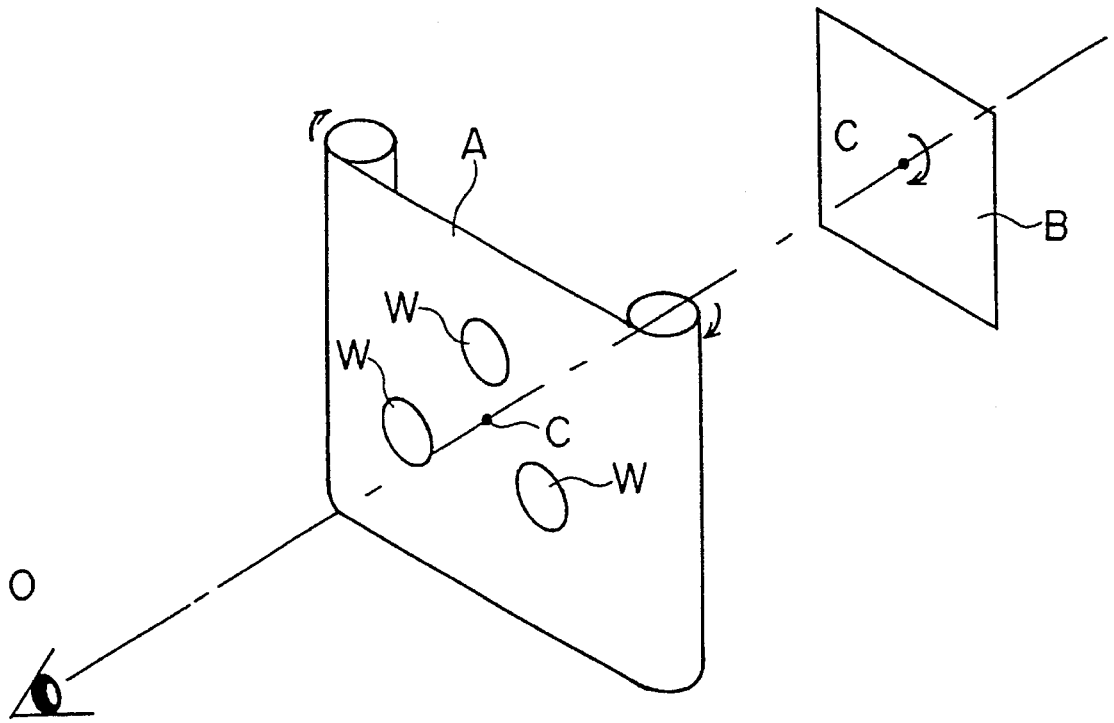
FIG. 24 is a diagram illustrating the construction of a 17th embodiment of the present invention.
Figure 25:
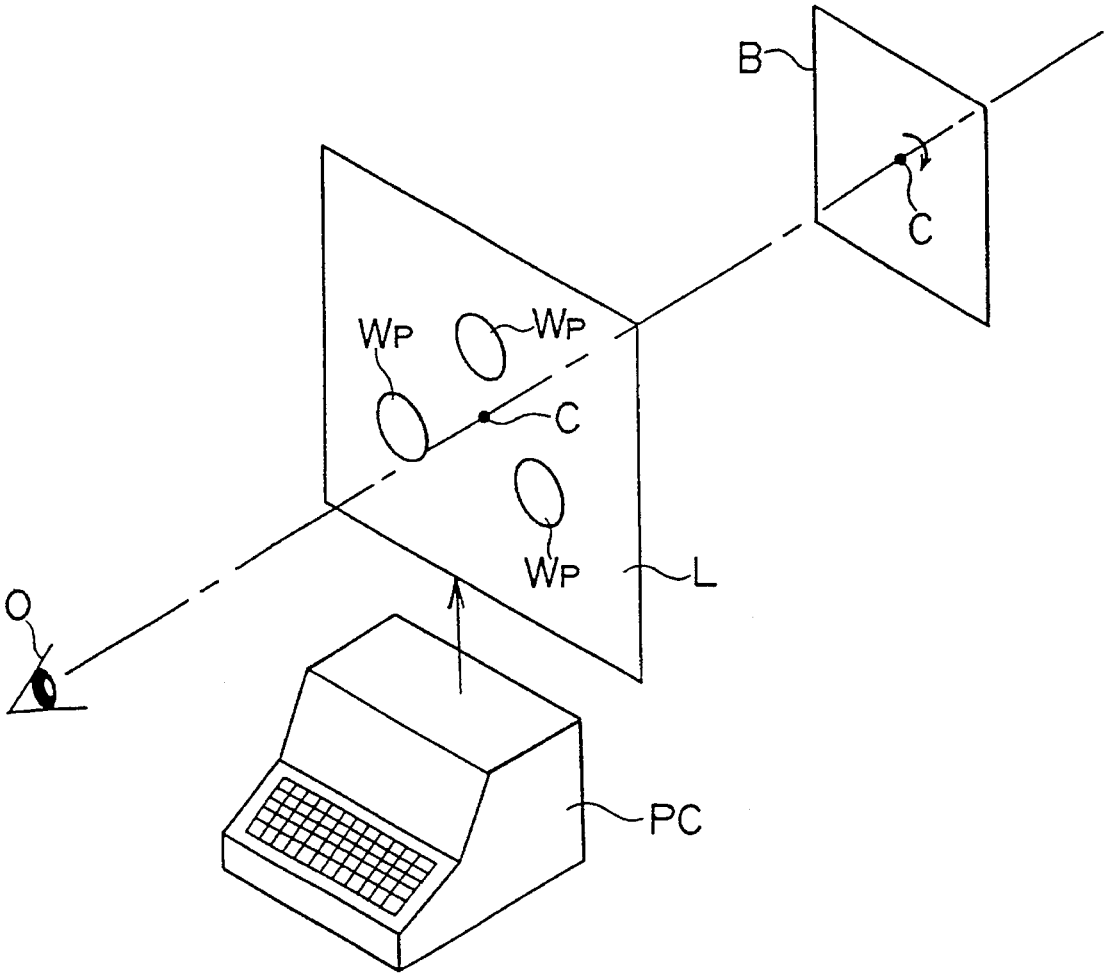
FIG. 25 is a diagram illustrating the construction of a 18th embodiment of the present invention.

The construction of 16th to 18th embodiments which realize this effect are illustrated respectively in FIGS. 23 to 25.

In the 16th embodiment illustrated in FIG. 23, a plurality (four) of different visual sense effect producing devices are parallelly disposed in the second object B in such a manner that the centers of these devices may fall on one circle. To be more specific, four second objects B1, B2, B3, and B4 different in polygonal shape are arranged on one circle and four first objects A1, A2, A3, and A4 different in kind are arranged on a structural member AR disposed rotatably at a center coinciding with the center of the circle correspondingly to the second objects B1, B2, B3, and B4. In this construction, the visual sense effect can be varied in kind by rotating the structural member AR with angles such that the positions of the first objects A1, A2, A3, and A4 may coincide with those of the second objects B1, B2, B3, and B4. The visual sense effect can be further enhanced by causing any of the first objects A1, A2, A3, and A4 which are disposed on the structural member AR to be so adapted as to allow collective observation of the second objects B1, B2, B3, and B4.

In the 17th embodiment illustrated in FIG. 24, a plurality of first objects A different in kind are formed on a rolling sheet. By winding this sheet on a roller and moving the first objects A, the first objects A can be altered in kind and different visual sense effects can be sequentially produced.

In the 18th embodiment illustrated in FIG. 25, a plate such as, for example, a liquid crystal image display panel which possesses the function of modulating light and therefore allows control of light penetration is used as the first object A and windows Wp for showing part of the second object B are displayed as controlled by a computer PC on the liquid crystal image display panel. The windows Wp thus displayed are varied in kind of pattern. The use of the liquid crystal image display panel in the manner described above can bring about an effect equivalent to what is obtained by interchanging the first objects A in kind. Incidentally, for the sake of varying the concealing parts in shape, such means as the liquid crystal image display panel can be similarly utilized.

As described above, the present invention enables an object of a polygonal shape which is not being physically enlarged, contracted, deformed, or eccentrically moved to be perceived with strange unexpectedness as though it were in the process of being enlarged, contracted, deformed, and eccentrically moved. Thus, the object acquires an effect of arousing attention on the part of spectators and enabling the spectators to perceive the object with peculiar impression.

Industrial Applicability

The present invention concerns an apparatus and a method for the formation of a visual sense effect. It enables an object of a polygonal shape which is not being physically enlarged, contracted, deformed, or eccentrically moved to be perceived as through the object were being enlarged, contracted, deformed, and eccentrically moved. Thus, it enables the object to arouse attention on the part of spectators and allows the spectators to perceive the object strongly with peculiar impression.

We claim:

1. An apparatus for the formation of a visual sense effect, comprising:

a first object having at least one window disposed around an axis of rotation; and a second object comprising a single polygonal shape having a closed periphery defined by an edge so disposed as to show at least a part of said edge of said closed periphery of said single polygonal shape through each said at least one window of said first object;

wherein said first object and said second object are rotatable relative to each other round said axis of rotation.

2. The apparatus according to claim 1, wherein said first object and said second object are optically projected.

3. The apparatus according to claim 1, wherein the apparatus further comprises means for varying said at least one window in shape and arrangement.

4. The apparatus as set forth in claim 1, wherein said at least one window comprises a plurality of windows.

5. The apparatus as set forth in claim 4, wherein said single polygonal shape having a closed periphery defined by an edge of the second object comprises a plurality of corners.

6. The apparatus as set forth in claim 5, wherein said single polygonal shape having a closed periphery defined by an edge comprises at least three corners.

7. The apparatus as set forth in claim 6, wherein said single polygonal shape having a closed periphery defined by an edge comprises three corners.

8. The apparatus as set forth in claim 6, wherein said single polygonal shape having a closed periphery defined by an edge comprises four corners.

9. The apparatus as set forth in claim 5, wherein said plurality of corners of said second object correspond in number to said plurality of windows of said first object.

10. The apparatus as set forth in claim 5, wherein said plurality of corners of the second object are different in number from said plurality of windows of the first object.

11. An apparatus for the formation of a visual sense effect, comprising:

a first object having concealing parts disposed around an axis of rotation; and a second object comprising a single polygonal shape having a closed periphery defined by an edge so disposed as to render at least a part of said edge of said closed periphery of said single polygonal shape invisible by being hidden behind said concealing parts of said first object;

wherein said first object and said second object are rotatable relative to each other round said axis of rotation.

12. The apparatus according to claim 11, wherein said first object and said second object are optically projected.

13. The apparatus according to claim 11, the apparatus further comprises means for varying the concealing parts in shape and arrangement.

14. A method for the formation of a visual sense effect, the method comprising the steps of:

providing a first figure corresponding to a first object having at least one window disposed around an axis of rotation;

providing a second figure corresponding to a second object comprising a single polygonal shape having a closed periphery defined by an edge so disposed as to show at least a part of said edge of said closed periphery of said single polygonal shape through each said at least one window of said first object; and displaying the first figure and the second figure on image planes rotated relative to each other around said axis of rotation.

15. The apparatus as set forth in claim 14, wherein said at least one window comprises a plurality of windows, and said single polygonal shape having a closed periphery defined by an edge comprises a plurality of corners different in number from said plurality of windows of the first object.

16. A method for the formation of a visual sense effect, the method comprising the steps of:

providing a first figure corresponding to a first object having concealing parts disposed around an axis of rotation;

providing a second figure corresponding to a second object of a single polygonal shape having a closed periphery defined by an edge so disposed as to render at least a part of said edge of said closed periphery of said single polygonal shape invisible by being hidden behind said concealing parts of said first object; and displaying the first figure and the second figure on image planes so as to be rotated relative to each other around said axis of rotation.

* * * * *